US005517962A

United States Patent [19]

Ling

[11] Patent Number: 5,517,962

[45] Date of Patent: May 21, 1996

[54] VARIABLE TIMING IGNITION CIRCUIT INCLUDING CONDITIONAL IGNITION RETARDING

[75] Inventor: Philip Ling, Kowloon, Hong Kong

[73] Assignee: Outboard Marine Corporation, Waukegan, Ill.

[21] Appl. No.: 354,532

[22] Filed: Dec. 13, 1994

[51] Int. Cl.[6] ..... F02P 11/02

[52] U.S. Cl. ..... 123/335; 123/418

[58] Field of Search ..... 123/335, 334, 123/418, 427, 415, 350, 351, 352

[56] References Cited

U.S. PATENT DOCUMENTS

| | | | |
|---|---|---|---|
| 3,882,835 | 5/1975 | Randriamanentena | 123/415 |
| 3,885,534 | 5/1975 | Webster | 123/415 |
| 4,059,083 | 11/1977 | Habert | 123/146.5 A |
| 4,131,098 | 12/1978 | Daniels et al. | 123/415 |
| 4,136,660 | 1/1979 | Palmer et al. | 123/335 |
| 4,138,982 | 2/1979 | Hattori et al. | 123/415 |
| 4,156,411 | 5/1979 | Crall et al. | 123/415 |
| 4,164,926 | 8/1979 | Kindlmann | 123/415 |
| 4,276,860 | 7/1981 | Capurka | 123/415 |
| 4,284,046 | 8/1981 | Hashimoto et al. | 123/418 |
| 4,301,778 | 11/1981 | Latapie | 123/426 |
| 4,638,785 | 1/1987 | Matsui et al. | 123/644 |
| 5,009,209 | 4/1991 | Okuda et al. | 123/415 |

*Primary Examiner*—Andrew M. Dolinar
*Attorney, Agent, or Firm*—Greer, Burns & Crain, Ltd.

[57] ABSTRACT

A variable integration based ignition circuit for an internal combustion engine recognizes predetermined engine conditions and modifies or limits ignition advance when the predetermined conditions are violated to protect the engine. The ignition circuit includes an ignition triggering circuit which causes the engine ignition to ignite in response to ignition pulse signals. A pulse generator generates and outputs signal pulses when the sensor detects positions of the crankshaft. A speed detector calculates the rotational speed of the flywheel based on the signal pulses. Ignition pulse signals are retarded when the rotational speed exceeds a predetermined level to limit rotational speed and protect the engine. The ignition circuit may also limit ignition pulse signals in response to low oil pressure.

7 Claims, 7 Drawing Sheets

WHERE SPEED $X' > X$ $Vp > Vp'$

VARIABLE TIMING IGNITION CIRCUIT INCLUDING CONDITIONAL IGNITION RETARDING

The invention relates generally to an ignition circuit for controlling the timing and firing of ignition in an internal combustion engine. The invention relates specifically to an ignition circuit for an internal combustion engine which is responsive to engine conditions and may disable ignition firing under predetermined, undesirable engine conditions.

BACKGROUND OF THE INVENTION

Internal combustion engines are designed to to operate within certain normal operating conditions. Operation outside of the designed normal operating conditions can be harmful to the engine. Two such conditions are oil pressure and rotating speed. Oil pressure serves to lubricate working parts of an internal combustion engine through the circulation of oil. Should the circulation of oil fall below a certain normal level because of insufficient oil pressure, the lubrication of the moving parts may be adversely affected. Similarly, operation at greater than a normal predetermined engine rotation speed may subject the engine to excessive destructive forces.

Ignition in an internal combustion engine, in addition to the above mentioned conditions, affects the performance of the engine. Efficient performance in an internal combustion engine is affected by the timing of the ignition with respect to the position of the piston in its upward travel within the cylinder in which it is housed. An igniter, such as a spark plug, gives ignition to gases in the cylinder to cause an explosion which drives the piston downward. At lower engine speeds, efficient engine performance is generally achieved by having ignition occur concurrently with the point at which the piston reaches its maximum point of upward travel, or the "top dead center". At higher engine speeds efficiency generally dictates that ignition take place at a point before the piston reaches the top dead center. The adjustment of the advance of ignition according to operating speeds of the engine is a major function of an ignition system.

Because efficiency of operation of an engine is dependent upon the relationship of ignition advance and engine rotational speeds, ignition advance in internal combustion engines is frequently controlled dependent on engine operating speed. Known mechanical ignition systems include means for varying the ignition advance mechanically. However, many modern engines utilize electronic ignition systems to control ignition advance. Generally, the electronic systems are employed to provide reliable and accurate ignition advance which is responsive to engine operating speed.

Typical known electronic ignition systems use a crankshaft flywheel position sensor to control the advance of ignition. Optic, magnetic or other suitable sensors capable of detecting positions on a crankshaft flywheel may be used. The flywheel will have positions marked thereupon for inducing responses from the particular sensor used. These types of systems may link the ignition control to the monitoring of predetermined positions of a crankshaft flywheel. The continuing detection of positions on the crankshaft flywheel allows both positional and rotational speed information to be obtained. In such systems the timing of the ignition will vary as a function of the rotational speed of the crankshaft.

Engines in which ignition systems are used may function over a wide range of operating speeds and other variable conditions. These conditions and operating speeds may change rapidly. The performance of the engine can be directly affected by the timing of the ignition. Thus, ignition systems should react predictably and accurately to the changing engine conditions.

To address these needs various electric and electronic ignition systems have been developed in the art. Electric and electronic systems are used to provide consistent and accurate ignition timing over various operating conditions. Several known systems have used integration functions coupled to the position sensor.

A typical system uses an integration circuit that is responsive to pulses proportional to rotational signals obtained by the sensor. The integration circuit is used to establish a dual time varying voltage signal for comparison with a reference voltage source. When the varying voltage is equal to the reference voltage source, an output pulse is initiated. A hysteresis circuit is used to adjust the magnitude of the reference voltage. Various other known ignition systems use integration based circuits in a similar fashion to effect ignition advance that varies with engine rotational speed.

However, such ignition circuits, while varying the ignition advance in relation to rotational speed, do not account for and limit or retard ignition where the rotational speed falls outside of a normal operating range. Similarly, such ignition systems fail to account for some other conditions which can affect engine performance.

SUMMARY OF THE INVENTION

It is an object of the present invention to provide an improved ignition circuit for use in an engine, including a sensor for detecting positions of a crankshaft flywheel that provides variable ignition advance and can limit or retard the ignition advance in response to predetermined engine conditions.

It is a further object of the invention to provide an improved ignition circuit for providing an ignition timing that can be controlled by the rotational speed of the engine crankshaft and that can adjust ignition advance to a minimum advance angle when the rotational speed of the engine is higher than a predetermined speed and can retard ignition signals.

Another object of the invention is to provide an improved ignition circuit for providing an ignition timing that can limit the speed of the engine when the oil pressure in the engine is below a predetermined level.

These and other objects and features of the present invention will be better understood by reading the detailed description including the appended claims and referring to the attached drawings.

DETAILED DESCRIPTION OF THE PREFERRED EMBODIMENT

Broadly stated, the present invention presents an improved ignition circuit which provides the consistent and desirable characteristics of an integration based ignition circuit while retarding or limiting ignition when undesirable conditions arise. Positional information concerning a rotating engine crankshaft is sensed. This positional information is employed to generate ignition signals and produce a dual ramp integration signal which is also used to generate ignition signals. In response to ignition signals, engine ignition pulses, used to ignite combustible engine gases, are produced. The use of the integration ramp signal allows attainment of variable timing characteristics.

The circuit also detects engine rotational speeds. The ignition circuit retards or limits ignition signals, or changes the advance angle, to reduce rotational speed when undesirable engine conditions are detected. Two such conditions are excessive rotational speed, and low oil pressure. Thus, the invention provides an improved timing integration based ignition circuit which advantageously retards, limits or changes the advance angle in response to undesirable engine conditions.

Figure 1:
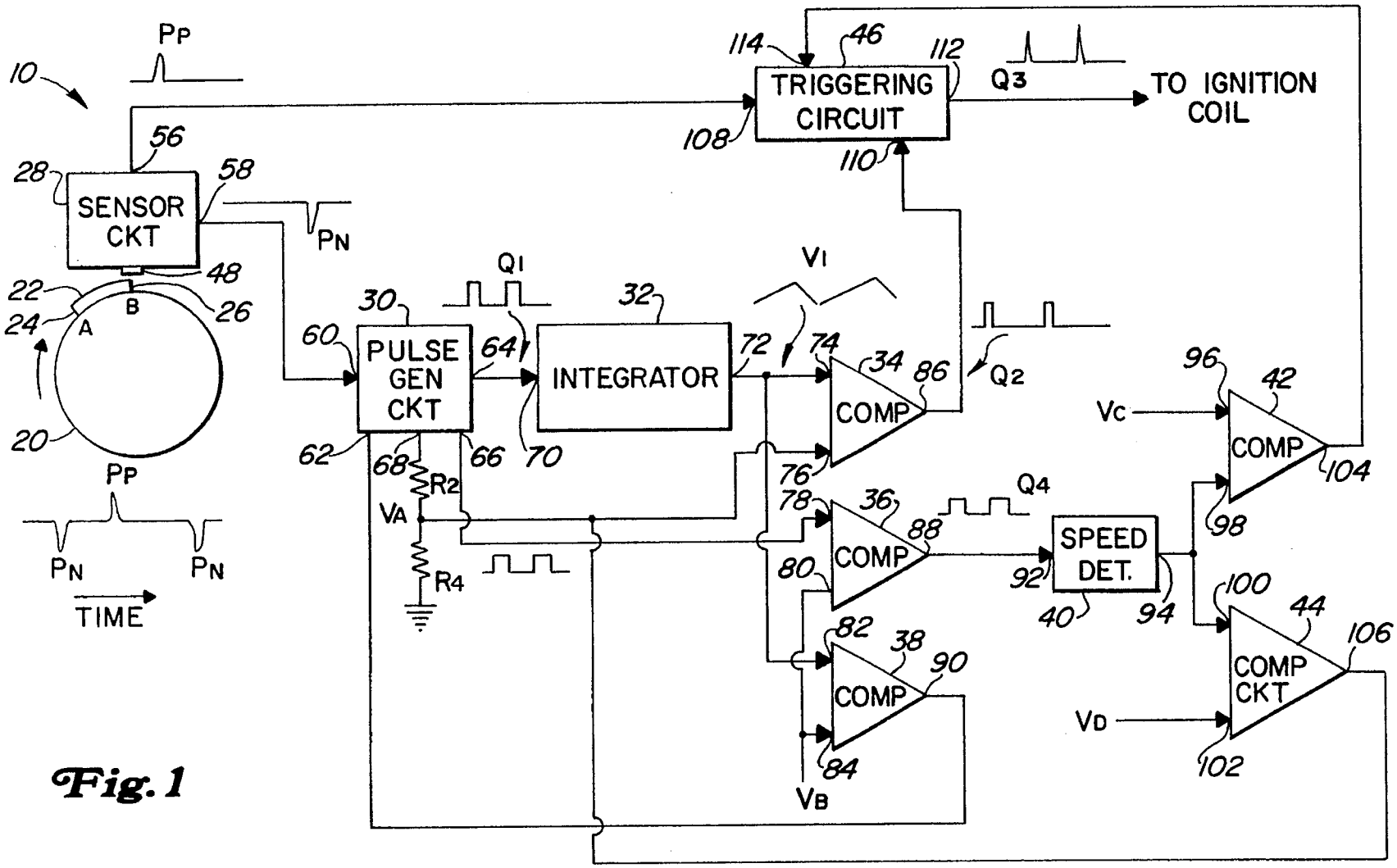
FIG. 1 is a block diagram of an ignition circuit in accordance with the present invention.

Turning now to the drawings, and particularly FIG. 1, an ignition circuit, indicated generally at 10, is shown which embodies the present invention. The ignition circuit 10 is responsive to a flywheel 20 that is attached to an engine crankshaft (not shown), and the flywheel 20 rotates with the crankshaft.

The ignition circuit responds to a protrusion 22 that is located on the flywheel 20. The protrusion 22 has opposite ends 24 and 26, which respectively define positions A and B on the flywheel 20. The distance between the ends 24 and 26 corresponds to the difference in width of the minimum and maximum ignition timing advance angles.

Figure 9A:
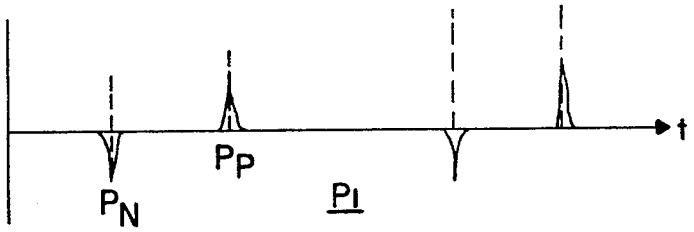
FIGS. 9*a*–9*e* are output signal diagrams of the output signals at various parts of the ignition circuit over a given time period under normal operating conditions.
Figure 9B:
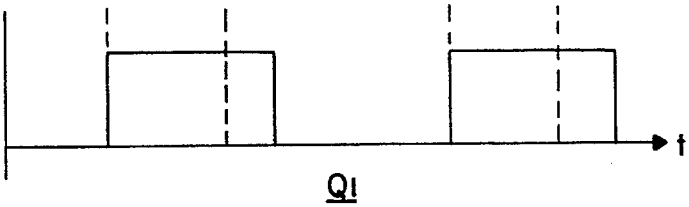
Figure 9C:
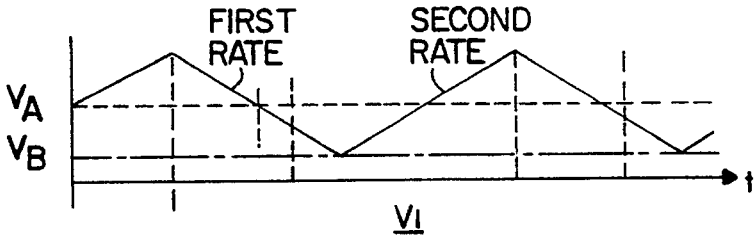
Figure 9D:
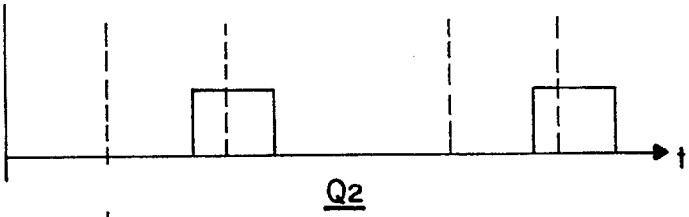

Response of the ignition circuit 10 is initiated by a sensor circuit 28 which produces pulses shown in FIG. 9A corresponding to protrusion ends of 24 and 26. Negative pulses $P_N$ from the sensor circuit 28 are applied to a pulse generator 30. Output Q, of the pulse generator is initiated by negative $P_N$ pulses as seen in FIG. 9*b*. An integrator 32 responds to the output Q, to produce a dual ramp signal as shown in FIG. 9C. Output comparators 34, 36 and 38 assess signals output from the integrator 32 and pulse generator 30. A speed detector 40 monitors engine rotational speed based on output of the comparator 36. An oil pressure comparator 42 compares a voltage related to engine oil pressure to the output of the speed detector 40 while a speed comparator circuit 44 compares a voltage related to harmful engine speeds to the output of the speed detector 40. An ignition triggering circuit 46 produces ignition trigger signals in response to the sensor circuit 28 and comparators 34 and 42.

A pickup 48, included in the sensor circuit 28 and disposed adjacently to the flywheel 20, responds to the protrusion ends 24 and 26. The pickup 48 may be magnetically or optically responsive. A magnetically responsive pickup 48 is shown in more detail in FIGS. 2*a* and 2*b*, with the flywheel 20 also being shown in FIG. 2*a*.

A magnet 50 protrudes from the pickup 48 and reacts to the protrusion 22. The magnet 50 is disposed adjacently to the flywheel 20 and is close to the flywheel protrusion 22 when rotation of the flywheel 20 causes the protrusion 22 to be in a position across from the magnet 50. The protrusion 22 should be made of a material to which the magnet 50 will respond. Soft iron or other similar material is suitable.

Figure 2B:
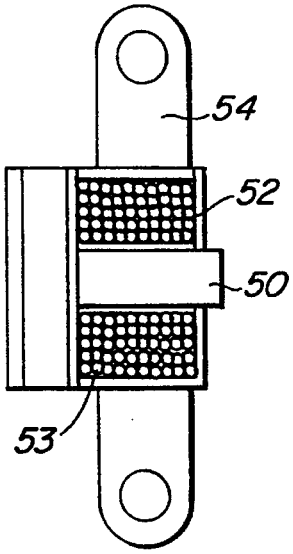
FIG. 2 shows the pickup employed in FIG. 1.
Figure 2A:
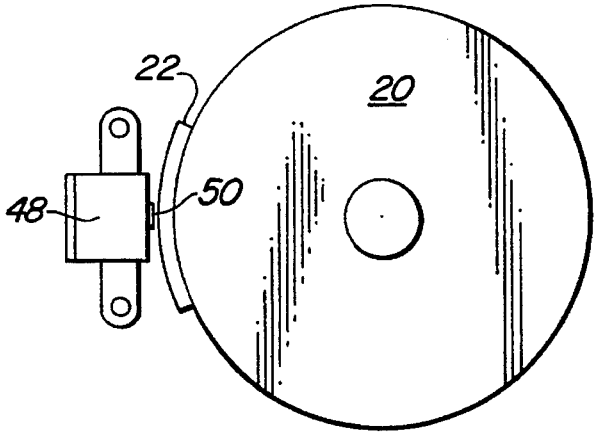

Referring now to FIG. 2*b*, which is a cross sectional view of the sensor 48, it includes the magnet 50 around which are windings 52 through which current induced by the magnet 50 flows. The windings 52 are completely enclosed in a casing 53, which the magnet 50 partially protrudes from casing 53. Attached to the casing 53 is a mounting bracket 54 for mounting the pickup 48 to an engine. It should be understood that other suitable means may replace the magnet 50, such as an optical sensor, e.g., a photo-detector.

Referring again to FIG. 1, the sensor circuit 28 has two outputs 56 and 58. The pulse generator 30 includes two input terminals 60 and 62, and three output terminals 64, 66, and 68. The integrator 32 has an input terminal 70 and output terminal 72. The comparators 34, 36 and 38 each respectively have two input terminals 74, 76, 78, 80, 82, 84 and one output terminal 86, 88, 90. The speed detector 40 includes an input 92 and output 94. Comparator circuits 42 and 44 respectively have two inputs 96, 98, 100, 102 and one output 104, 106. The ignition triggering circuit 46 includes three inputs 108, 110 & 114 and one output 112.

The sensor circuit output 56 is connected to the ignition trigger input 108, while the sensor circuit output 58 is connected to the pulse generator input 60. The pulse generator Output 64 is connected to the integrator input 70, the pulse generator output 66 is connected to comparator input 78, and the pulse generator output 68 is connected, via a voltage divider consisting of resistors R2 and R4, which provides voltage $V_A$ to comparator input 76. The integrator output 72 is connected to the comparator inputs 74 and 82 and comparator inputs 80 and 84 are connected to a predetermined reference voltage $V_B$. An examplary value for $V_B$ is $2.5_v$. The comparator output 86 is connected to ignition trigger input 110, comparator output 88 is connected to speed detector input 92, and comparator output 90 is connected to pulse generator input 62. The speed detector output 94 is connected to comparator input 98 and comparator circuit input 100. The comparator input 96 is connected to a predetermined reference voltage $V_c$ and comparator circuit input terminal 102 is connected to a predetermined reference voltage $V_D$. The comparator output 104 is connected to ignition triggering input 114 and comparator circuit output 106 is connected to comparator input 76 between the resistors R2 and R4. The ignition trigger output 112 is connected to an engine ignition coil (not shown).

Figure 3:
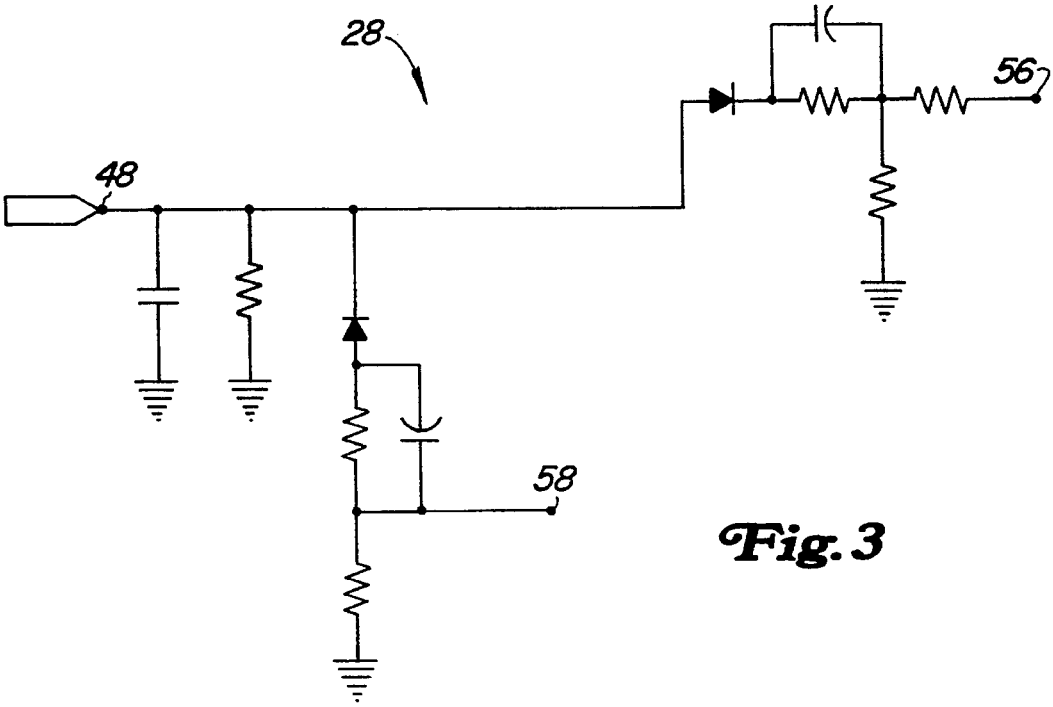
FIG. 3 is a specific circuit configuration for realizing the sensor circuit shown in FIG. 1.

A specific configuration for realizing the sensor circuit 28 of FIG. 1 is shown in FIG. 3. The input and output terminals are labelled in accordance with the reference numerals shown in FIG. 1.

Figure 4:
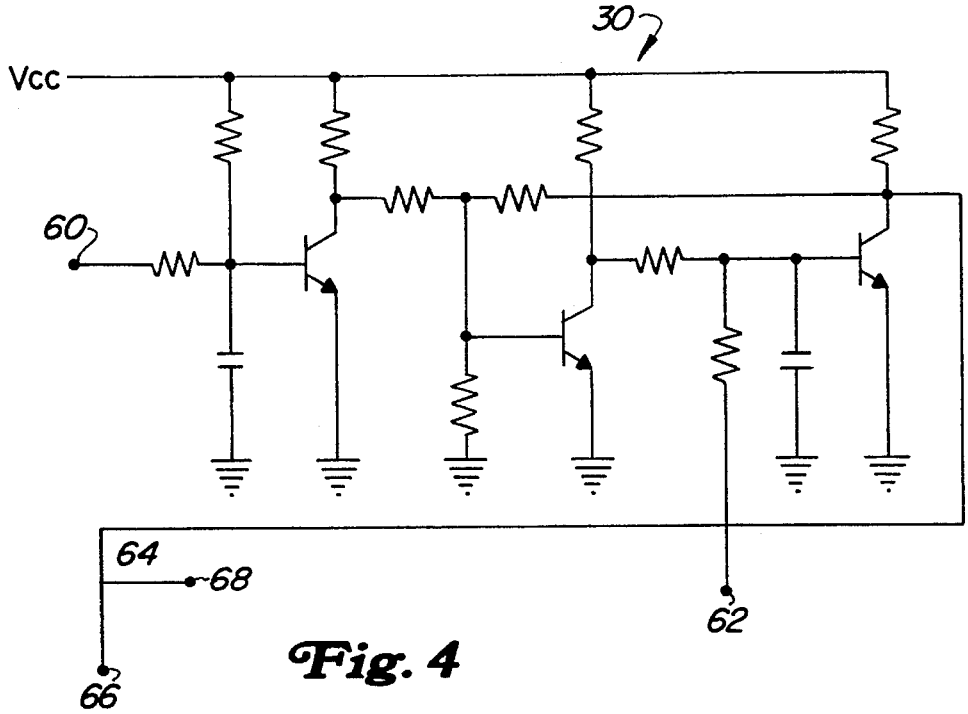
FIG. 4 is a specific circuit configuration for realizing the pulse generator shown in FIG. 1.

A specific configuration for realizing the pulse generator 30 of FIG. 1 is shown in FIG. 4 . Input and output terminals are labelled in accordance with FIG. 1.

Figure 5:
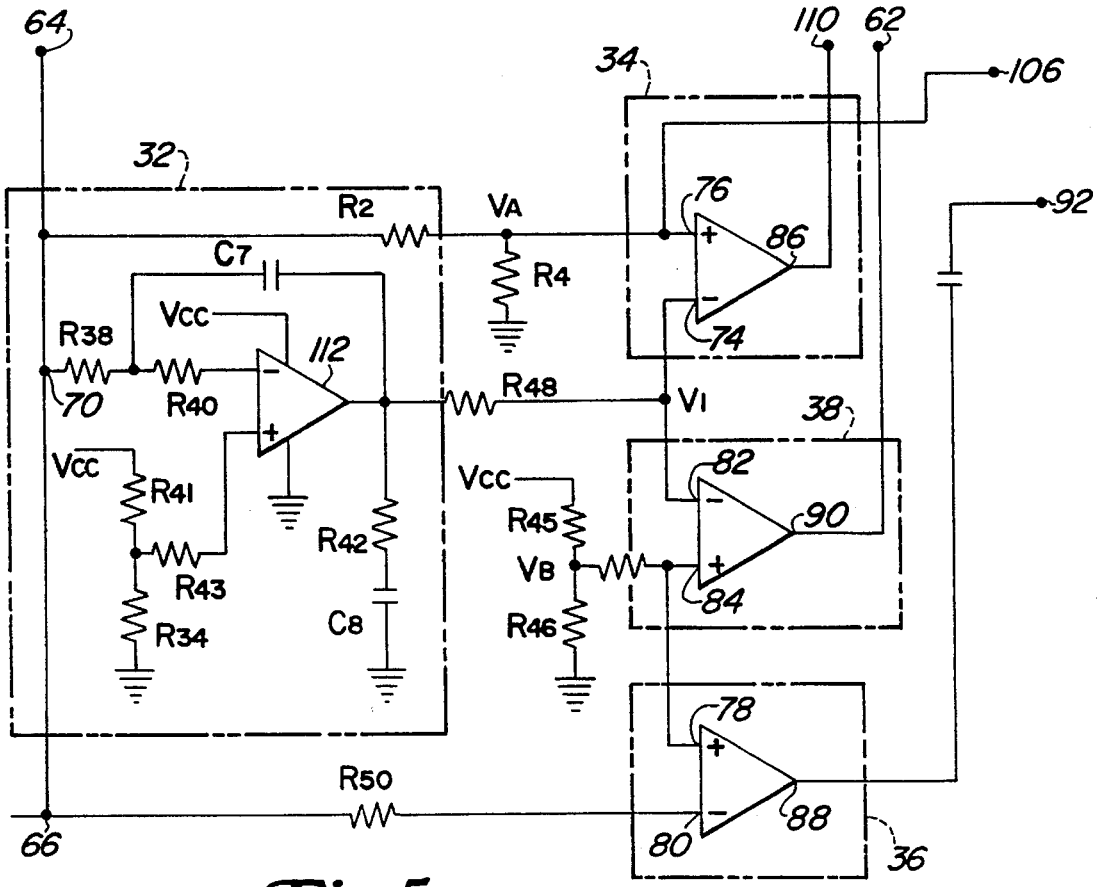
FIG. 5 is a specific circuit for realizing the integrator and associated comparators shown in FIG. 1.

Specific configurations for realizing the integrator 32 and comparators 34, 36 and 38 of FIG. 1 are shown in FIG. 5 . The integrator 32 includes resistors R38, R39, R40, R41, R42, and R43, capacitors C7, C8 and operational amplifier 112 which is connected to voltage source $V_{cc}$. The integrator 32 is connected to the comparators 34 and 38 as shown. A predetermined reference voltage $V_B$ is obtained through a resistor circuit including resistor R45 and resistor R46 connected to voltage source $V_{cc}$. The various inputs and outputs to the ignition trigger 46, the speed detector 40 and the pulse generator 30 are labelled with reference numerals in accordance with FIG. 1. Additionally, a resistor R48 is connected to the integrator output 72 and a resistor R50 is connected to the pulse generator output 66.

Figure 6:
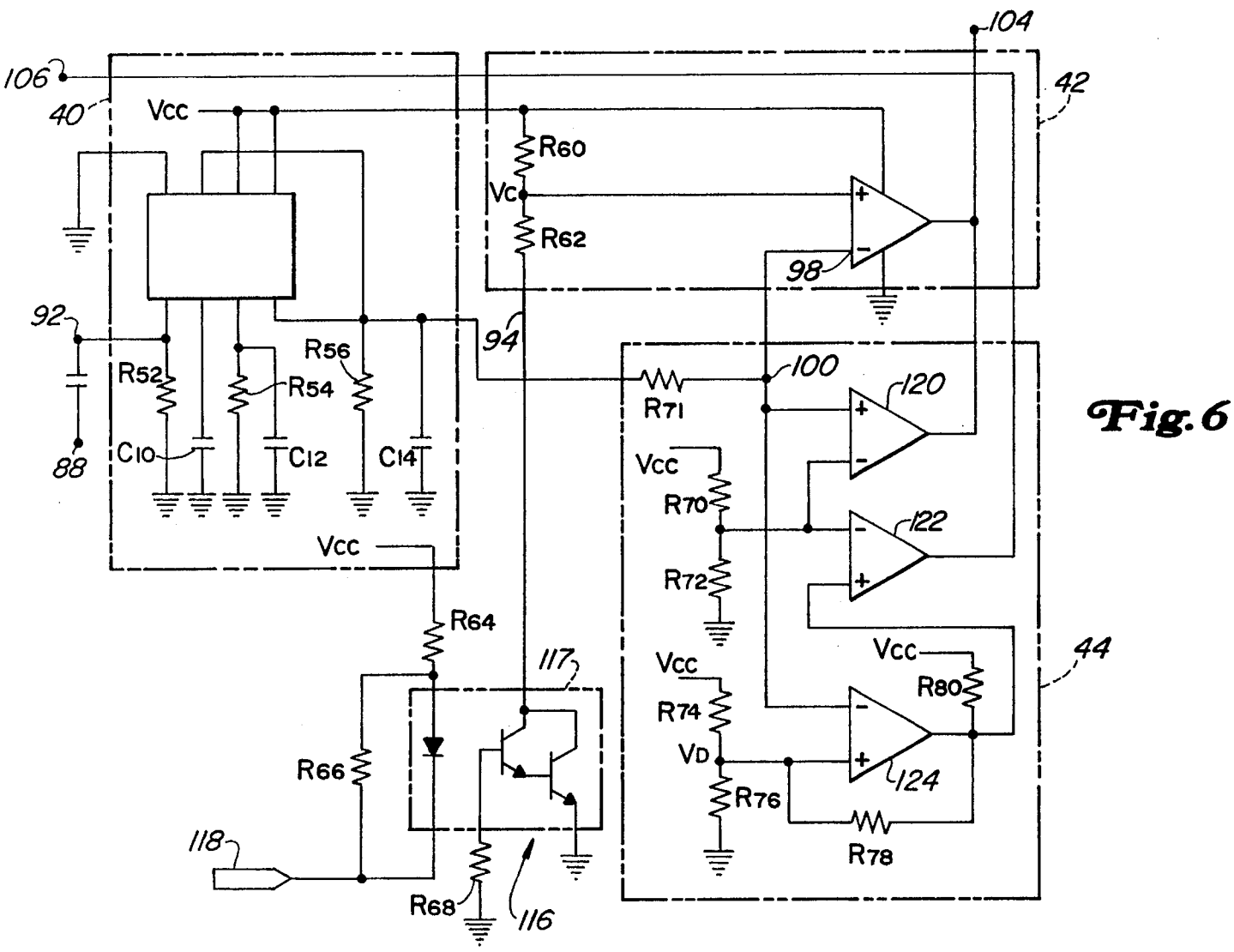
FIG. 6 shows specific circuit for realizing the speed detector, speed limiter and oil pressure comparator circuits shown in FIG. 1.

Specific configurations for realizing the speed detector 40 and the comparator circuit 44 of FIG. 1 are Shown in FIG. 6. The speed detector 40 and comparator circuit 44 are shown connected to the input 98 of comparator 42. The speed detector 40 includes a frequency logic chip 93. (a LM2907 frequency to voltage converter I.C. is suitable) resistors R52, R54, R56, and capacitors C10, C12, C14. Shown connected to the comparator 42 and the voltage source $V_{cc}$ are resistors R60, R62. The predetermined reference voltage $V_c$ is developed between the resistors R60 and R62. Also shown is a oil pressure transducer circuit 116 connected to resistor R60. The transducer circuit 116 includes an oil pressure transducer 118, resistors R64, R66, R68 and opto-coupler 117 (a 4N32 model is suitable). The transducer circuit 116 serves to vary $V_c$ in accordance with engine oil pressure. The comparator circuit 44 includes resistors R70, R72, R74, R76, R78, R80 and comparators 120, 122, and 124. A resistor R71 is connected between the speed detector output 94 and the comparator input 98 as well as the comparator circuit input 100.

Figure 7:
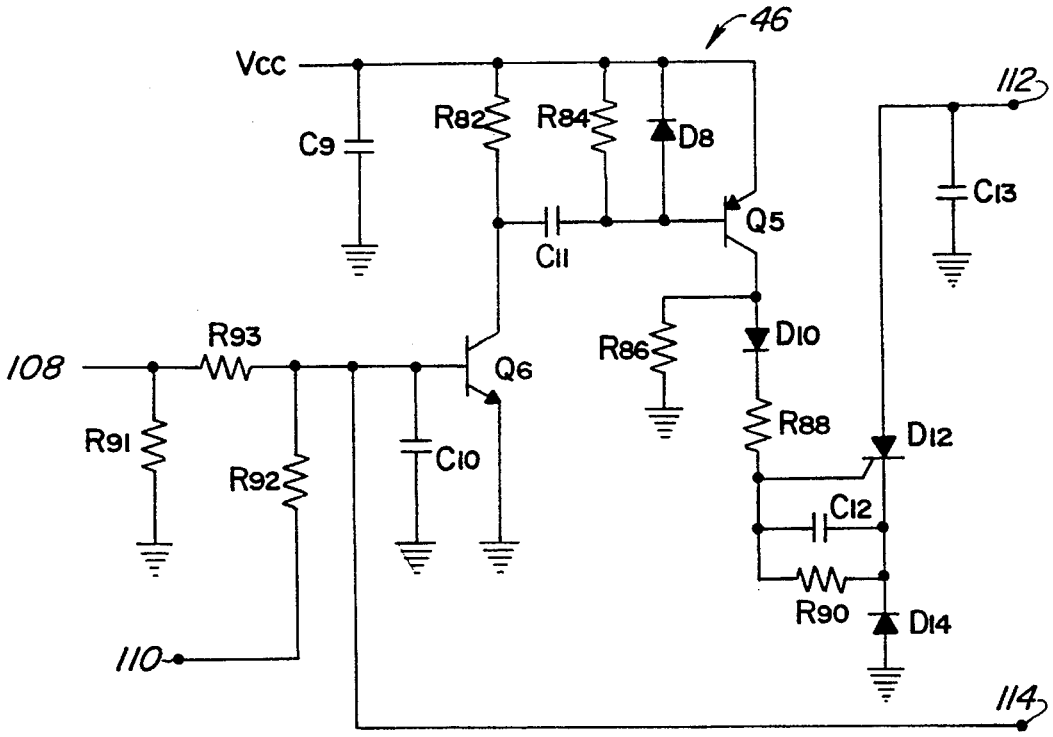
FIG. 7 shows a specific circuit for the pulse triggering circuit shown in FIG. 1.

A specific configuration for realizing the ignition triggering circuit 46 of FIG. 1 is shown in FIG. 7 and includes resistors R82, R84, R86, R88, R90, R91, R92, R93 capacitors C9, C10, Cll, C12, C13, diodes D8, D10, D14, transistors Q5, Q6 and SCR D12.

With respect to the operation of the ignition circuit 10 and referring to FIG. 1, when the rotating crankshaft flywheel 20 reaches position B corresponding to the maximum advance angle position the pickup 48 will be opposed to protrusion end 26. At this point the pickup 48 senses the protrusion end 26, and the sensor circuit 28 produces a negative output pulse $P_N$ which is applied via sensor output 58 to the pulse generator 30 at input 60.

As a result, the signal $Q_1$ at the outputs 64, 66 and 68 of the pulse generator changes to a high potential which is applied to the integrator input 70. In response to the change of signal $Q_1$ to high potential, the integrator 32 begins to output a dual ramp voltage signal $V_1$, at the integrator output 72, at a decreasing voltage of constant slope, e.g. a negative integration is commenced. The signal $V_1$ is applied to the comparator inputs 74, 82. The signal $Q_1$ from the pulse generator 30 is applied at comparator input 78 via the resistor R50. Further, the signal $Q_1$ is divided through the resistors R2 and R4 and $V_A$ is applied to the comparator input 76.

Figure 9E:
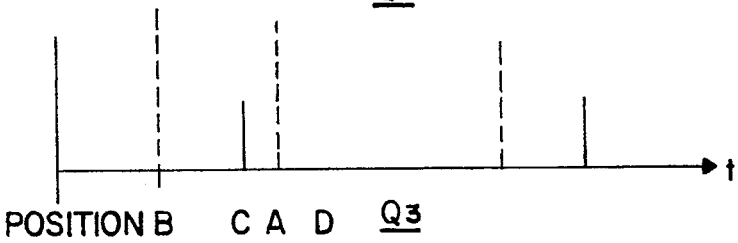

As the integrator 32 continues producing the signal $V_1$ as a decreasing voltage of constant slope, a point is reached where the signal $V_1$ presented to comparator input 74 becomes smaller than the signal $V_A$ presented to the comparator input 76. At this point, the output signal $Q_2$ of the comparator 34 changes to high potential. The high signal $Q_2$ is then applied to the ignition triggering input 110 which produces an ignition pulse $Q_3$ voltage spike, at output 112. During the time that the signal $V_1$ decreases, the crankshaft flywheel 20 continues its rotation. The point at which the comparator 34 produces the high potential signal $Q_2$ is defined as a position C of the crankshaft flywheel 20 across from the pickup 48 when the comparator 34 output signal $Q_2$ goes high. This position C is not labelled on the flywheel since it may vary according to engine rotational speed but is shown in the waveform of FIG. 9E.

As the crankshaft continues its rotation the protrusion end 24, position A of the crankshaft flywheel 20, will come to be disposed across from pickup 48. In response, the sensor circuit 28 produces a positive pulse $P_p$. This signal $P_p$ is applied to the ignition triggering input 108 through the sensor circuit output 56. The signal $P_p$ is utilized by the ignition triggering circuit 46 to produce the voltage pulse spikes of output $Q_3$ when the engine rotational speed is low. When the rotation speed is lower than a particular speed, for instance 1500 RPM, the comparator 34 will be disabled. In such a case, the triggering circuit 46 will be activated only by the input 108.

Additionally, whether the ignition pulse spikes are produced in response to $P_p$ or the pulses of output $Q_2$, the integrator 32 continues producing the signal $V_1$ at decreasing slope. When the signal $V_1$ falls to the predetermined reference voltage $V_B$, the comparator 38 produces a high potential. This is applied to the pulse generator input terminal 62 through the comparator output terminal 90. In response, the pulse generator 30 is reset and the integrator 32 begins outputting the signal $V_1$ as an increasing voltage ramp of constant slope. This positive integration continues until the crankshaft flywheel 20 again rotates to a point where protrusion end 26 is disposed across from pickup 48 at point B and the negative pulse $P_n$ is produced to induce the pulse generator 30 to start the negative integration of the integrator 32. The point of rotation of the crankshaft flywheel 20 when the integrator 32 changes $V_1$ to an increasing voltage may be defined as position D of the crankshaft flywheel 20, and is determined when a high pulse applied to the integrator 32 terminates and the $Q_1$ signal goes low. The position D is not labelled on the crankshaft flywheel 20 since it will change with the rotational speed of the crankshaft flywheel 20, but is shown on the waveform of FIG. 9E.

Variable timing is realized because the peak voltage $V_p$ of the integrator output signal $V_1$ is dependent upon the length of time during which the integrator 32 is allowed to continue outputting the positive ramp portion $V_1$, i.e., until the negative pulse $P_N$ is produced as a result of the protrusion end 26 reaching position B. The slower the rotational speed of the crankshaft flywheel 20, the longer the time period before the negative pulse $P_N$ is produced and the longer the positive integration is allowed to continue. When the peak voltage $V_p$ becomes higher, the period of negative integration before the decreasing voltage signal $V_1$ reaches the predetermined reference voltages $V_A$ and $V_B$ is longer. Thus, the timing of the ignition signal $Q_2$ initiated by the comparator 34 positive output to the ignitional triggering circuit 46 is changed.

Figure 8:
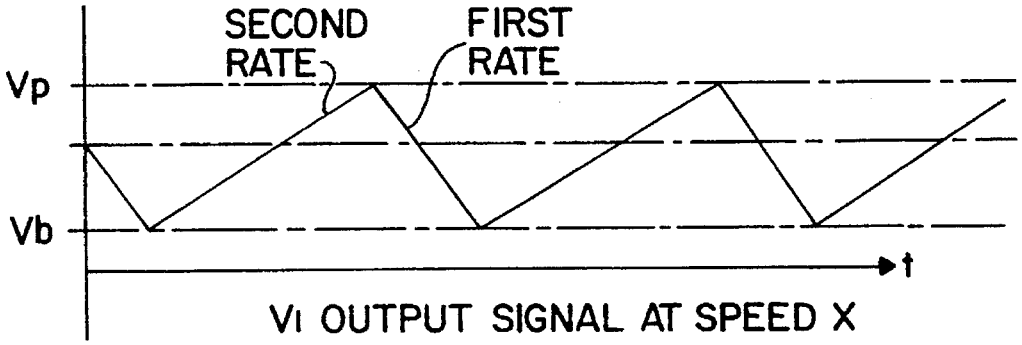
FIG. 8 is an output signal diagram illustrating the integrator output signal at different engine rotational speeds.
Figure 8:
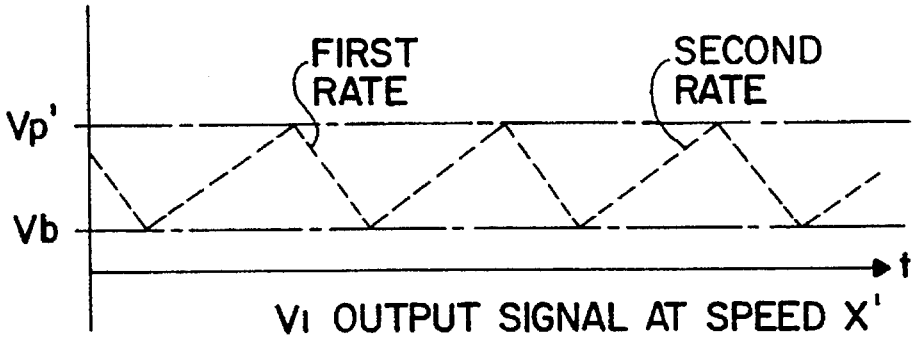

The relationship between the speed of crankshaft rotation and the integration output signal $V_1$ is illustrated in FIG. 8, which shows the integrator output $V_1$ during a negative integration is at the constant first rate, and during a positive integration, at the constant second rate. The first rate has a slope which is approximately double that of the second rate. Of course, this may be varied to effectuate desired timing characteristics. Because the rates remain constant, lower rotational speeds allow positive integration to occur for a longer time, thus producing a higher peak voltage $V_p$. Increased peak voltage $V_p$ results in a longer time before the voltage $V_1$ decreases to the predetermined reference voltage $V_B$ where the signal from comparator output 90 to input 62 to reset the pulse generator 30 is produced. Thus, the peak voltage $V_p$ is inversely proportional to the shaft rotational speed X.

In accordance with an important aspect of the present invention which serves to protect the engine, the circuitry limits the maximum speed of operation in the following fashion. The comparator 36 produces an output $Q_4$ consisting of a series of pulses. The output $Q_4$ pulses possess a frequency identical to the frequency of output $Q_1$ of the pulse generator 30. The speed detector 40 proportionally converts the pulse frequency to a voltage and outputs the voltage through output 94. As the frequency of the output pulses $Q_4$ increase, the voltage at speed detector output 94 also increases and is applied to comparator input 98 and comparator circuit input 100. When the speed detector output 94 reaches predetermined reference voltage $V_D$, the comparator circuit 44 produces an output through comparator circuit output 106 which sets $V_A$ at a level that disables the comparator 34. A 0 V level may be used for this purpose. This prevents the comparator output 86 from generating output $Q_2$, which affects initiating of ignition triggering pulse signal $Q_3$ spikes. As a result, the ignition signal $Q_3$ will be initiated only by the positive pulses $P_p$ upon detection of the protrusion end 24. This serves to change the advance timing to the minimum advance angle when a predetermined undesirable engine rotational speed is reached. In other words, ignition is retarded when the signal for the comparator 34 is inhibited. The comparator circuit 44 will hold the comparator input 76 to a disable or inhibited level until the speed proportional voltage output at the speed detector output 94 falls below predetermined reference voltage $V_D$. Through this operation the ignition circuit 10 monitors engine conditions related to rotational speed and limits rotational speeds by changing the ignition advance angle when a predetermined undesirable speed is reached. Thus, potentially destructive forces related to excessive speed are avoided.

In accordance with another aspect of the present invention which serves to protect the engine, the ignition circuit 10 is also responsive to engine oil pressure conditions. Oil pressure monitoring is effectuated through use of the comparator 42. The input 98 of the comparator 42 receives the speed proportional voltage from the speed detector output 94. When the speed proportional voltage presented to comparator input 98 becomes higher than the predetermined reference voltage $V_c$, corresponding to a given oil pressure, the comparator 42 produces an output signal that is sent to ignition trigger input 114 via comparator output 104. The comparator output signal disables the ignition triggering circuit 46 for as long as the comparator input 98 is higher than Voltage $V_c$. Thus, when oil pressure is low, rotational speed will be limited. Through this operation, the likelihood of engine damage is greatly reduced.

The predetermined reference voltage $V_c$ is varied through the oil pressure transducer circuit 116 shown in FIG. 6. As the oil pressure transducer 118 senses low oil pressure, the opto-coupler 117 (4N32), will be turned on & cause R62 to be connected to ground, thereby reducing the reference voltage Vc. At a normal condition, the voltage at terminal 94 of speed detector A0 is always lower than the input 96 of comparator 42. When oil pressure is low and the terminal 94 of speed detector 40 is higher than Vc, the output 104 of comparator 42 will change state to disable the circuit 46 through terminal 114.

It should be understood that the signals in FIG. 9 are taken during a period of normal operation, i.e., when the speed and oil pressure conditions of the ignition circuit 10 have not been violated. Thus, the signals in FIG. 9E correspond to the point at which the signal $Q_1$ equals the reference voltage $V_A$ and the comparator 34 initiates ignition by producing the output signal $Q_2$. In contrast, in the case where the comparator circuit 44 was responding to limit speed, the output signals of FIG. 9E would correspond to the positive pulses $P_p$ since the reference voltage $V_A$ would be held outside, (for example Va=0V) of the range of the integrator output signal $V_1$.

The above embodiment discussed with reference to FIGS. 1–9 is illustrative of objects and features of the present invention. Those skilled in the art will recognize that other modifications and specific embodiments are within the scope of the present invention. For example, additional engine conditions could be monitored through addition of comparison circuits responsive to other desired engine condition such as heat. Circuit parameters may be modified to accommodate for specific desired responsiveness to speed, advance angle, and oil pressure. Further, the particular form of logic applied, i.e., positive or negative, may be changed. The scope of the present invention will best be understood by the appended claims and legal equivalents thereof.

What is claimed is:

1. An ignition circuit for an engine ignition having a sensor circuit for detecting positions of a crankshaft connected to the engine, said circuit comprising:

ignition triggering means for generating ignition pulses for causing the engine ignition in response to ignition signals being applied thereto;

pulse generator means for generating and outputting signal pulses when the sensor detects a first position of the crankshaft;

integrator means for producing an integrator output of a changing voltage at a first slope in response to said pulses and of a changing voltage at a second slope in response to a reset signal;

first comparator means for comparing said changing voltage of said second slope to a first reference voltage, said comparator means producing a first ignition signal when said changing voltage at said second slope is equal to said first reference voltage, said first ignition signal being applied to said ignition triggering means;

second comparator means for comparing said integrator output to a second reference voltage and for producing said reset signal when said integrator output equals said second reference voltage;

speed detection means for determining a rotational speed of said flywheel based on said signal pulses; and protection means for inhibiting said ignition signals when undesirable engine conditions are detected, said protection means including speed limiting means for setting said first reference voltage at a disable level which prevents said first comparator from generating said first ignition signal when said rotational speed exceeds a predetermined level.

2. The ignition circuit of claim 1 wherein said protection means further includes low oil pressure detection means for detecting a low oil pressure of the engine and disabling said ignition triggering means from responding to said first and second ignition signals when said low oil pressure is detected and said rotational speed exceeds a predetermined level.

3. An ignition circuit for an engine ignition having a sensor circuit for detecting positions of a crankshaft connected to the engine, said circuit comprising:

ignition triggering means for generating ignition pulses for causing the engine ignition in response to ignition signals being applied thereto:

pulse generator means for generating and outputting signal pulses when the sensor detects a first position of the crankshaft;

integrator means for producing an integrator output of a changing voltage at a first slope in response to said pulses and of a changing voltage at a second slope in response to a reset signal;

first comparator means for comparing said changing voltage of said second slope to a first reference voltage, said comparator means producing a first ignition signal when said changing voltage at said second slope is equal to said first reference voltage, said first ignition signal being applied to said ignition triggering means;

second comparator means for comparing said integrator output to a second reference voltage and for producing said reset signal when said integrator output equals said second reference voltage;

speed detection means for determining a rotational speed of said flywheel based on said signal pulses; and protection means for inhibiting said ignition signals when undesirable engine conditions are detected;

said sensor circuit producing a second ignition signal in response to the sensor detecting a second position of the flywheel, said second ignition signal being applied to said ignition triggering means;

said protection means further comprising:

low oil pressure detection means for detecting a low oil pressure of the engine and disabling said ignition triggering means from responding to said first and second ignition signals when said low oil pressure is detected and said rotational speed exceeds a predetermined level; and speed limiting means for setting said first reference voltage at a disable level which prevents said first comparator from generating said first ignition signal when said rotational speed exceeds a predetermined level.

4. The ignition circuit of claim 3 wherein said ignition means responds to said second ignition signal at low rotational speeds and said ignition triggering means responds to said first ignition signal at other rotational speeds.

5. The ignition circuit of claim 4 wherein said speed detection means comprises a frequency to voltage converter which produces a proportional voltage that varies with a frequency of said pulses; and said speed limiting means comprises a comparator circuit which compares said proportional voltage to a third reference voltage and said comparator circuit setting said first reference voltage below said second reference voltage to disable said first comparator when said proportional voltage exceeds said third reference voltage.

6. The ignition circuit of claim 4, said speed detection means comprises a frequency to voltage converter which produces a proportional voltage that varies with a frequency of said pulses; and said low oil pressure detection means comprising a comparator which compares said proportional voltage to a fourth reference voltage, said comparator disabling said ignition triggering means when said proportional voltage exceeds said fourth reference voltage.

7. The ignition circuit of claim 6, said fourth reference voltage being set by an oil pressure transducer circuit which varies said fourth reference voltage with engine oil pressure.

* * * * *